US006500382B2

(12) United States Patent
Reichel et al.

(10) Patent No.: US 6,500,382 B2
(45) Date of Patent: Dec. 31, 2002

(54) METHOD AND APPARATUS FOR SLAG-FREE TEEMING OF METAL MELT FROM A METALLURGICAL MELT VESSEL

(75) Inventors: Jan Reichel, Düsseldorf (DE); Reinhard Fuchs, Wassenberg (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/816,250

(22) Filed: Mar. 22, 2001

(65) Prior Publication Data

US 2001/0040321 A1 Nov. 15, 2001

(30) Foreign Application Priority Data

Mar. 24, 2000 (DE) ..... 100 14 712

(51) Int. Cl.[7] ..... C21B 7/12
(52) U.S. Cl. ..... 266/45; 266/230
(58) Field of Search ..... 266/45, 227, 228, 266/230, 275; 75/375, 582, 584

(56) References Cited

U.S. PATENT DOCUMENTS 2,828,516 A * 4/1958 Black et al. ..... 266/227
5,203,909 A * 4/1993 Petrushka et al. ..... 75/375
5,544,867 A * 8/1996 Neyer ..... 266/45

FOREIGN PATENT DOCUMENTS

| | | |
|---|---|---|
| DE | 9808318 | 9/1998 |
| DE | 9916222 | 10/2000 |
| EP | 0321861 | 6/1989 |
| WO | 3419489 | 9/1994 |
| WO | 9419498 | 9/1994 |

OTHER PUBLICATIONS

Patent Abstract of Japan, Publication No. 10176212. Published Jun. 30, 1998.

* cited by examiner

*Primary Examiner*—Scott Kastler
(74) *Attorney, Agent, or Firm*—Sidley Austin Brown & Wood, LLP

(57) ABSTRACT

A method of slag-free teeming of metal melt includes arranging outside of the metal vessel and closely adjacent to the discharge edge of the vessel discharge opening, of a jetting lance an inclination of which relative to a bath surface in the vessel and spacing from the discharge edge is changeable and injecting, through the discharge opening of the melt vessel, immediately before start of the teeming process and during the teeming process, a fluid jet having a high kinetic pulse energy substantially parallel to the bath surface for forcing a slag melt, which is located in a discharge region of the vessel and covers the metal melt, back.

10 Claims, 1 Drawing Sheet

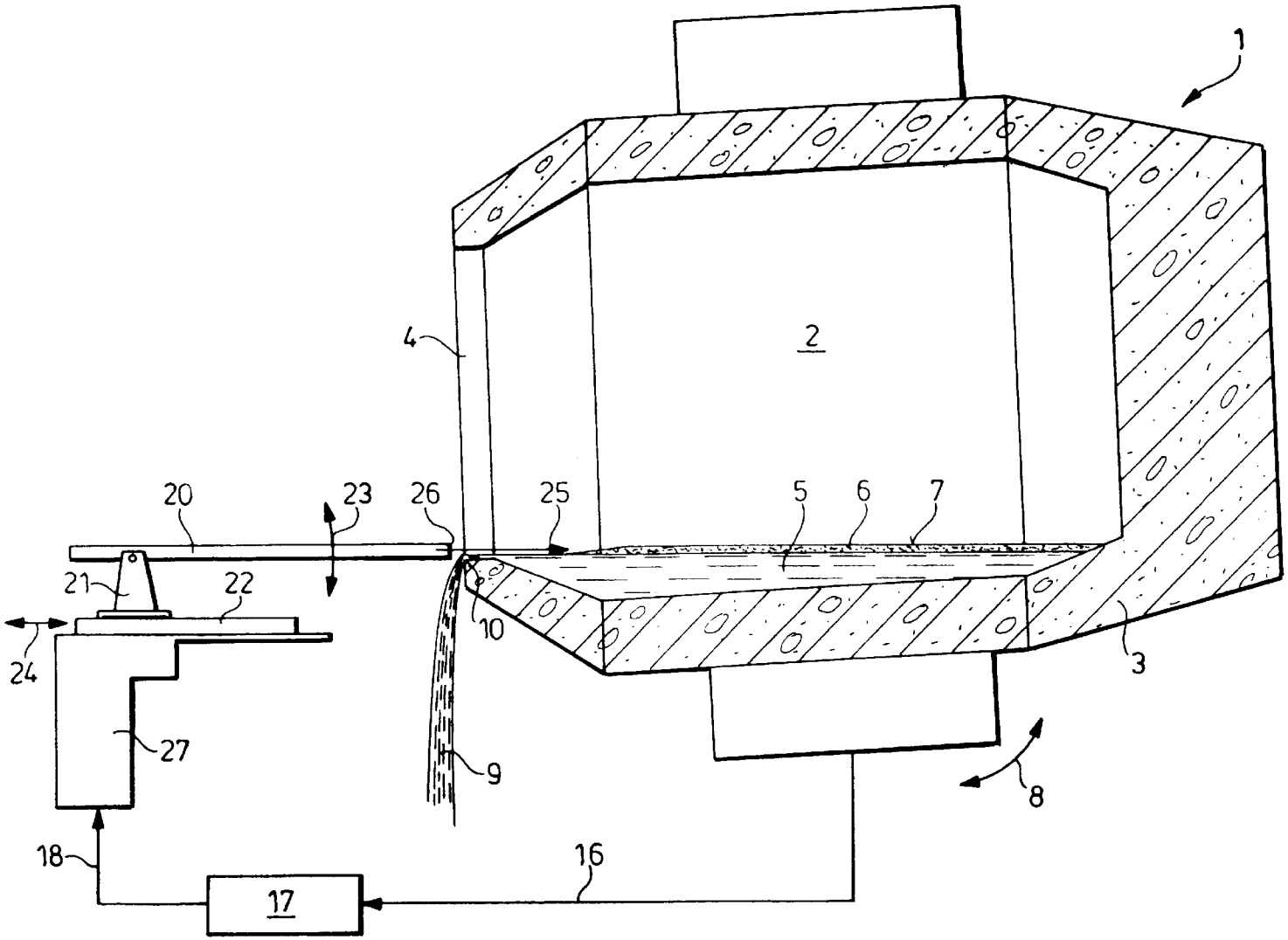
1
2
3
4
5
6
7
8
9
10
16
17
18
20
21
22
23
24
25
26
27

METHOD AND APPARATUS FOR SLAG-FREE TEEMING OF METAL MELT FROM A METALLURGICAL MELT VESSEL

BACKGROUND OF THE INVENTION

1. Field of the Invention

The present invention relates to a method of and an apparatus for slag-free teeming of metal melt from a metallurgical vessel, e.g., a converter, according to which at the start of the teeming or pouring process, the slag melt, which covers the metal melt in the discharge region of the vessel, is forced back or is blown away.

When a metal is subjected to a thermal metallurgical process or to alloying in a metallurgical melt vessel, after conclusion of the process, the molten metal or the metal melt is covered with a molten slag or the slag melt.

During the teeming or pouring of the metal melt from a metallurgical vessel, there exists a danger that the originally available separation between the metal and slag melts, which is caused by swirling, is not available any more, and the slag melt is poured from the melt vessel together with the metal melt.

The oxidic slag, which is poured together with the metal melt, contains oxygen, which results in an additional consumption by aluminum, for a necessary deoxidation, of synthetic slags for absorbing oxides and calcium in order to modify the oxidic inclusions. The oxidation product, alumina ($Al_2O_3$), adversely affects the pouring characteristics, and the oxygen of FeO, which is contained in the slag, makes the desulphurization and degasification more difficult. Contrary to this, with a reduced slag content in the metal melt, e.g., "Clean Steel" handling of steel melt in secondary metallurgy is substantially facilitated, which plays a significant role, in particular, in production of steels with an ultra-low carbon content for producing flat products.

In order to reduce the flow of slag, together with the metal melt, different methods and apparatuses were proposed. Thus, German utility model DE298 08 318 U1 proposes to arrange around a discharge opening, which is formed in the vessel bottom, a plurality of gas-permeable, truncated cone-shaped rinsing blocks through which from beneath, in a direction opposite to the flow direction of the metal melt, a gas is injected into the metal melt. This measure should provide a swirl above the discharge opening.

WO 94/19498 suggests, for preventing flow of slag together with the metal melt through a discharge opening in the vessel bottom, providing of a jetting lance, which is inserted from above through the cover of the melt vessel, for blowing the slag melt away from the bath surface in the region of the discharge opening.

In accordance with another embodiment of the invention disclosed in WO 94/19498, the lance is introduced through a side opening in the vessel and is brought to a vicinity of the discharge opening. In this embodiment, the front end of the lance is bent downward, with the jet acting on the bath surface from above.

The drawback of both known methods and apparatuses consists in high investment and operational costs (wear of the lance and the rinsing blocks, high gas consumption) associated with prevention of flow of the slag together with the metal melt during discharge of the metal melt from a metallurgical vessel through an opening in the bottom of the vessel.

Another drawback of the proposed solutions consists in that with the slag melt being blown away from above, there exists a danger of swirling which can break the original separation of the slag and metal melts and which causes introduction of gases into the metal melt which is highly undesirable. In addition to the introduction of gases into the metal melt during introduction of gases with the lance, as a result of an "open-jet effect," the surrounding air is introduced, together with the gases. Thus, in addition to the introduction of the undesirable nitrogen, introduction of the undesirable oxygen takes place.

Accordingly, an object of the present invention is to provide a method of and an apparatus for teeming of metal which would insure a slag-free teeming of the metal melt to a most possible extent by preventing swirling.

Another object of the present invention is to provide a method of and an apparatus for a slag-free teeming of the metal melt which would not require high investment and operational costs.

SUMMARY OF THE INVENTION

These and other objects of the present invention, which will become apparent hereinafter, are achieved by arranging, outside of the melt vessel and closely adjacent to the discharge edge of the vessel discharge opening, of a jetting lance an inclination of which relative to a bath surface in the vessel and spacing from the discharge edge is changeable, and by injecting, through the discharge opening of the melt vessel, immediately before start of teeming process and during the teeming process, a fluid jet having a high kinetic pulse energy substantially parallel to the bath surface for forcing the slag melt, which is located in the discharge region of the vessel, back from a surface of the metal melt, whereby pouring of the slag melt together with the metal melt is prevented.

The apparatus for effecting the above-described method includes a jetting lance located outside of the vessel opposite the discharge edge for forcing slag melt covering metal melt in a discharge region of the vessel back, and a manipulator for supporting the jetting lance and for changing an inclination of the jetting lance relative to a bath surface in the vessel and for changing spacing of the jetting lance from the discharge edge.

By directing, according to the present invention, a fluid jet with a high kinetic pulse energy somewhat parallel to the bath surface from the outside of the vessel sidewise against the slag melt layer, the slag melt is forced back from the discharge opening and is prevented from being poured out together with the metal melt. The forcing of the slag melt layer back from the surface of the metal melt, by directing a fluid jet substantially parallel to the bath surface, is effected without creation of any swirling. As a result, the drawbacks of the known solutions, according to which the jets are directed onto the bath surface from above which causes penetration of the slag melt into the metal melt, are eliminated by the present invention.

In order to insure that during the teeming process, the slag melt is constantly and in the desired manner is forced back from the metal melt in the discharge region, according to the present invention, the inclination of the jetting lance relative to the bath surface and the spacing of the jetting lance from the discharge edge of the metal melt are continuously changed and follow the pouring or discharge movement of the melt vessel.

In accordance with inclination positions of the melt vessel during the teeming process, the spacing of the discharge nozzle of the jetting lance from the exit edge varies from 0.1 m to 3 m, preferably from 0.2 m to 2 m, and the inclination of the jetting lance to the horizontal or to the bath surface varies from −15° to +60°, preferably, from −10° to +45°.

According to the present invention, for changing the position of the jetting lance, there is provided a manipulator on which the jetting lance is supported by a support mounted on a slide connected with the manipulator. For controlling the operation of the manipulator, there is provided a measuring and control system.

According to the present invention, the data, which characterize the melt vessel movement during the teeming process, are continuously collected and are communicated to a measuring and control system, which processes the data and generates control signals for controlling the operation of the manipulator.

According to the present invention, as an injected fluid, an inert gas, e.g. nitrogen or argon, is used. Also, a suitable liquid can be used for forming the injectable fluid jet.

According to the present invention, an opening of the discharge nozzle, which is provided at the lance front end, has a rectangular, substantially slot-shaped cross-section aligned with a horizontal or with the bath surface. The shape of the discharge opening of the discharge nozzle is adapted to the size of the discharge surface, which corresponds to the amount of the discharged metal melt, and to the usable fluid. The width and shape of the discharge nozzle should correspond to the volume of the discharged gas necessary for forcing back the slag melt in the discharge edge region and for preventing flow of boundary streams of the slag melt in a direction toward the discharge edge.

According to the present invention, the jetting lance is located outside of the melt vessel and remains outside of the vessel during the teeming process. The advantage of this consists in that the wear of the lance, e.g., as a result of oxidation, is practically eliminated, and any insulating measures become unnecessary. This also contributes to the reduction of investment and operational costs.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

Single FIGURE of the drawing shows a vertical cross-sectional view of a melt vessel used with an apparatus according to the present invention.

DETAILED DESCRIPTION OF THE PREFERRED EMBODIMENT

A melt vessel 1, which is shown in the drawings, has a melt chamber 2 on the bottom of which formed of a refractory lining 3, metal melt 5 accumulates. The metal melt 5 is covered with slag melt 6.

In the drawing, the melt vessel 1 is shown during the teeming process. The melt vessel 1, which pivots in directions shown by a double arrow 8, is inclined to the left toward the discharge opening 4 so that the metal melt 5 flows out of the vessel 1 through the discharge opening 4 of the vessel 1 over a discharge edge 10 as a pouring stream 9 of molten metal.

Outside of the melt vessel 1, opposite the discharge edge 10, a jetting lance 20 is arranged. The jetting lance 20 is so aligned that its front end 26 with, preferably, a rectangular slot-shaped nozzle (not shown) is located closely adjacent to the molten metal discharge edge 10, and a fluid jet 25, which emerges from the nozzle, is directed substantially parallel to the bath surface 7 to the most possible extent. Thereby, a spreading effect is achieved. This measure results in the slag melt 6 being forced back from the surface of the metal melt 5 in the region of the discharge edge 10. As a result, the pouring stream 9 substantially consists only of the metal melt 5. The fluid jet 25 is directed substantially parallel to the surface of the metal melt 5 to a most possible extent. This prevents an undesirable intermixing of the metal melt 5 with the slag melt 6 which can occur as a result of swirling produced when the fluid jet spreads at an angle to the bath surface.

In order to retain the desired alignment of the jetting lance 20 also during the change of the position of the melt vessel 1 during following inclination movements of the melt vessel 1, the jetting lance 20, together with its support 21, is arranged on a manipulator 27. The support 21 is so formed that the jetting lance 20 can pivot in directions shown by a double arrow 23 and is displaceable horizontally in directions shown by a double arrow 24. To insure a horizontal displacement of the jetting lance 20, the lance support 21 is supported on the slide 22 provided on the manipulator 27.

Because the pivotal and horizontal movements of the jetting lance 20 in the directions 23, 24 must so be controlled by the manipulator 27 that the jetting lance 20 continuously follow the discharge movement of the melt vessel 1, the manipulator 27 should insure a corresponding adaptation of the alignment of the jetting lance 20 with the actual position of the melt vessel 1 at all times, i.e., continuously. To this end, the data of the melt vessel movement during the teeming process are continuously collected and communicated via a conductor 16 to a measuring and control system 17. The measuring and control system 17 processes the data any generates control signals for controlling the operation of the manipulator 27 To this end, the measuring and control system 17 is connected with the manipulator by a conduit 18.

Though the present invention was shown and described with references to the preferred embodiment, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. An apparatus for slag-free teeming of a metal melt from a metallurgical melt vessel having a discharge opening with a discharge edge, the apparatus comprising a jetting lance located outside of the vessel opposite the discharge edge for forcing back slag melt covering metal melt in a discharge region of the vessel; and a manipulator for supporting the jetting lance and for changing an inclination of the jetting lance relative to a bath surface in the vessel and for changing spacing of the jetting lance from the discharge edge in accordance with a discharge movement of the melt vessel.

2. An apparatus as set forth in claim 1, further comprising a measuring and control system for collecting data characterizing a position of the vessel and for controlling operation of the manipulator in accordance with a change of the position of the vessel; and conductor means for connecting the measuring and control system with the vessel and the manipulator.

3. An apparatus as set forth in claim 1, wherein the jetting lance comprises a substantially rectangular slot-shaped nozzle.

4. A method of slag-free teeming of metal melt from a metallurgical melt vessel having a discharge opening with a discharge edge, the method comprising the steps of arranging, outside of the melt vessel and closely adjacent to the discharge edge of the vessel discharge opening, of a jetting lance for injecting, through the discharge opening of the melt vessel, immediately before start of a teeming process and during the teeming process, of a fluid jet having a high kinetic pulse energy; and changing an inclination of the jetting lance relative to a bath surface and spacing of the jetting lance from the discharge edge in accordance with a movement of the melt vessel for directing the fluid jet substantially parallel to the bath surface for forcing a slag melt, which is located in a discharge region of the melt vessel, back from a surface of the metal melt to prevent the slag melt from being poured out of the melt vessel, together with the metal melt.

5. A method as set forth in claim 1, further including a step of providing a manipulator for continuously changing the inclination of the jetting lance relative to the bath surface and the spacing of the jetting lance from the discharge edge, and a measuring and control system for controlling an operation of the manipulator.

6. A method as set forth in claim 4, wherein the changing step includes changing the inclination of the jetting lance relative to the bath surface from −15° to +60° and changing the spacing of the jetting lance from the discharge edge from 0.1 m to 3 m.

7. A method as set forth in claim 6, wherein the changing step includes changing the inclination of the jetting lance relative to the bath surface from −10° to +45° and changing the spacing of the jetting lance from the discharge edge from 0.2 m to 2 m.

8. A method as set forth in claim 4, wherein the fluid jet is an inert gas jet.

9. A method as set forth in claim 8, wherein the inert gas is selected from a group consisting of nitrogen and argon.

10. A method as set forth in claim 4, wherein the fluid jet is a liquid jet.

* * * * *